US005263266A

United States Patent [19]

Schmidt

[11] Patent Number: 5,263,266

[45] Date of Patent: Nov. 23, 1993

[54] LOW-EMISSION DRYING OF WOOD CHIPS

[75] Inventor: Alfred Schmidt, Vienna, Austria

[73] Assignee: M. Kaindl Holzindustrie, Wals, Austria

[21] Appl. No.: 613,653

[22] PCT Filed: May 10, 1989

[86] PCT No.: PCT/AT89/00047

§ 371 Date: Nov. 13, 1990

§ 102(e) Date: Nov. 13, 1990

[87] PCT Pub. No.: WO89/11072

PCT Pub. Date: Nov. 16, 1989

[30] Foreign Application Priority Data

May 10, 1988 [AT] Austria ..... 1225/88

[51] Int. Cl.[5] ..... F26B 3/00

[52] U.S. Cl. ..... 34/32; 34/79

[58] Field of Search ..... 34/32, 79, 13.4, 13.8, 34/191, 60, 86, 16.5

[56] References Cited

U.S. PATENT DOCUMENTS 3,875,678 4/1975 Vits ..... 34/79 X 4,135,309 1/1979 Bosnjak ..... 34/17 X

*Primary Examiner*—Henry A. Bennett

*Attorney, Agent, or Firm*—Bell, Seltzer, Park & Gibson

[57] ABSTRACT

A process for the low-emission drying of wood chips has a first dryer (2) directly heated by means of a combustion chamber (3). Arranged in series in relation to this dryer (2) is a second, indirectly heated dryer (5) whose exhaust air is recycled to the combustion chamber (3) via line (7). The exhaust gases discharged from the dryer (2) are passed to a second combustion chamber (11) where they are heated to at least 300° C., whereby the pollutants are eliminated. The heat used for this purpose can be recovered by means of a waste heat boiler (14) and used for heating the second dryer (5).

26 Claims, 2 Drawing Sheets

FIG. 2
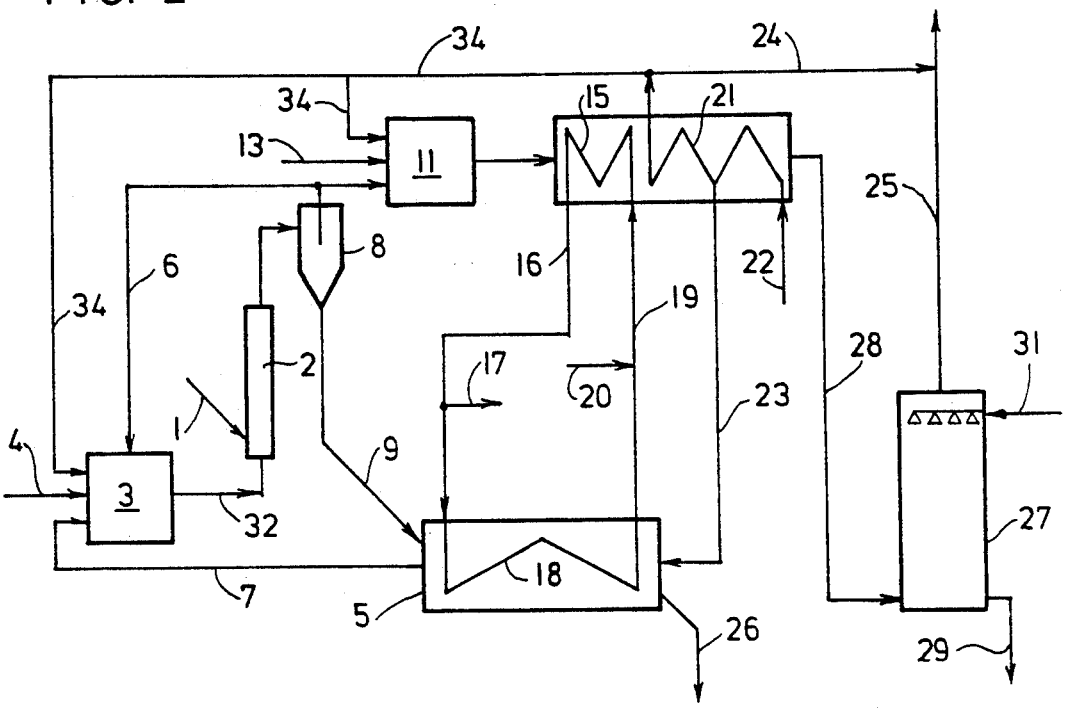
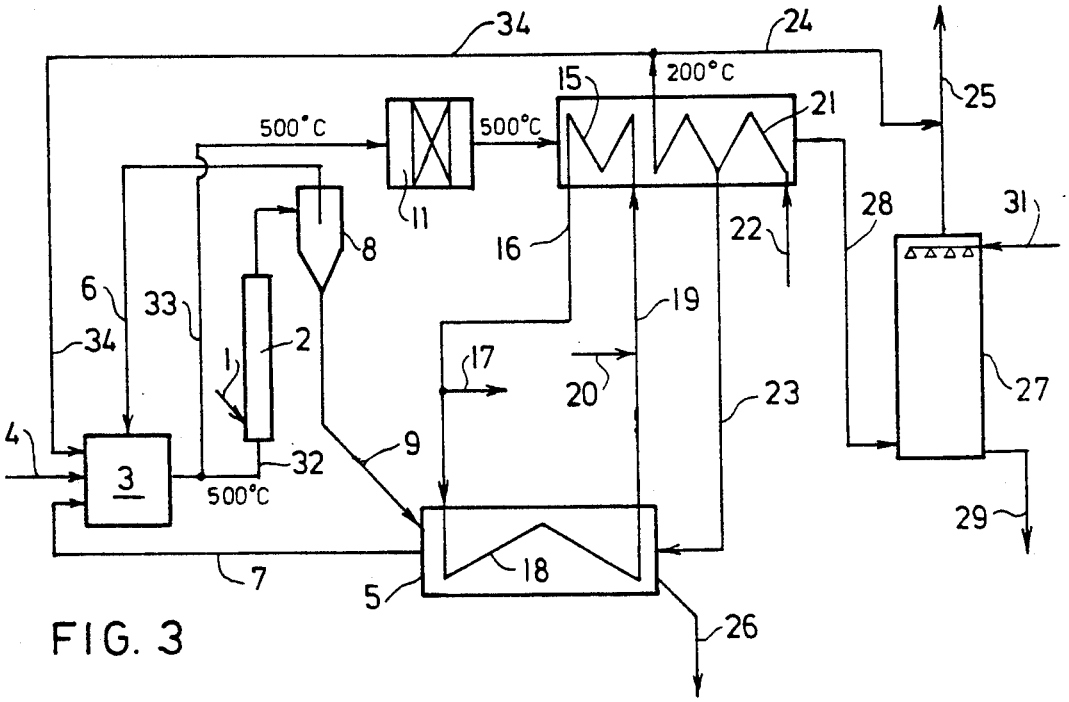
FIG. 3

LOW-EMISSION DRYING OF WOOD CHIPS

The present invention relates to a process of low-emission drying of wood chips in which the moist chips are first dried in a first preferably directly heated drying stage and postdried in a second drying stage. The invention further relates to an apparatus for carrying out the process having a first, preferably directly heated dryer for predrying the moist wood chips and a second dryer disposed downstream from the first one.

Dryers disposed in series for the drying of materials are known from e.g. DE-OS 26 40 508 and 35 34 260. The thermal purification of exhaust gases is further known in principle from DE-PS 36 16 333. A process and an apparatus of the type initially mentioned ar further known from DE-OS 28 21 689. No indications are made as to the extent of drying, the type of heating the dryer and the treatment of the exhaust gases.

It is known that large amounts of wood chips are required for the production of particle board, wherein the wood chips are first mixed with a binder, mostly a urea formaldehyde resin, and are then pressed in presses into boards at high pressure and high temperature. If the water content of the wood chips used is too high, an explosion-like destruction of the board occurs on taking it out of the press due to the sudden expansion of the steam present inside of the board. The wood chips must thus be predried to a maximum water content of 6 percent by weight (based on absolute dry weight of the board prior to pressing. But as fresh wood chips, depending on the type of wood, the season of felling and the storage conditions, have a moisture content of 50 to 150 percent by weight, about 100 percent by weight on the average, based on the dry weight of the wood, the drying of the wood chips from this relatively high water content to the required 1 to 6 percent by weight requires a large amount of heat, so that the degree of thermal efficiency is of particular importance in technical drying processes.

The drying of wood chips entails the further problem that in addition to wood, resin-like components such a terpene and mainly α-pinene are contained in them in addition to cellulose, hemicellulose and ligrin. A portion of these substances has a comparatively low boiling point and is moreover volatile in steam. As a result, the exhaust gases of chip drying plants contain substances of this type in addition to steam. Although these substances are not toxic in the narrow sense, they still impart to the exhaust vapors of the dryer a characteristic unpleasant odor. Although this pollution can be reduced by using the essentially less resinous deciduous wood instead of the highly resinous coniferous wood, resulting in lower terpene emission, this gives rise to another problem: the exhaust gas of dryers also contains small amounts of wood dust in addition to the substances mentioned. It was found that certain types of wood dust, mainly those of beech and oak, might be carcinogenic, and as a result, the admissible limit values for the dust content in the exhaust gas when using these types of wood are drastically reduced. The normal dust collectors such as multicyclones are no longer adequate here and special filters, in particular fibrous filters, must be used, although the high water content of the exhaust gas of the dryer causes frequent operational failures.

Finally, the dryer exhaust gas may contain substances formed by thermal degradation of one or more components of the wood (cellulose, ligrins, resins and the like), such as various aldehydes and acids such as formaldehyde, acetaldehyde, acetic acid and the like. The formation of such substances occurs particuarly if high drying temperatures are used in the dryer, such as they usually prevail in directly heated dryers. Although these substances are normally contained in the exhaust gas in low concentrations (of about 10 to 30 percent of those of terpenes), they are hygienically precarious and some of them have an unpleasant, pungent odor, thus pollute the environment.

Attempts to eliminate the undesirable substances from the exhaust gases of wood chip dryers have been largely unsuccessful. Washing of the exhaust gases with water in order to remove the organic substances is possible, but removes only a portion of the contaminants, as about 70 to 80 percent of the respective substances remain in the exhaust gas due to the high steam pressure. Moreover, the washings must be subjected to a complicated purification before they can be released into the outfall ditch.

It was further proposed to effect the drying of the wood chips not by means of the conventional, directly heated dryers, thus by direct drying with hot flue gases, but instead by means of indrectly heated dryers. Since in indirectly heated dryers, the temperature of the heating means (steam, compressed water, thermal oil) can be lowered to a maximum of 200° C., while in directly heated dryers, the flue gas inlet temperature into the dryer is normally 400° to 600° C., a considerable reduction of thermal degradation of the wood components is possible in indirectly heated dryers, although the problem of terpene emission remains unsolved because their release from the wood chips is largely independent of temperatures.

It is the object of the invention to provide a process for the low-emission drying of wood chips of the type initially mentioned in which these disadvantages are eliminated and the drying of the chips to a low final humidity content can be effected without essential emission of pollutants. The invention solves this problem in a process of the type initially mentioned by drying the wood chips predried in the first dryer stage to a humidity content of about 20 to 50 percent in the second, dryer stage disposed downstream from this dryer stage to a final humidity content of 1 to 6 percent; the second dryer stage being indirectly heated, the organic substances contained in both dryer stages being destroyed prior to discharge into the atmosphere by oxidation at elevated temperatures by heating the exhaust gases of both dryer stages in at least one combustion chamber, preferably in this combustion chamber as the first one and then in a second combustion chamber disposed in series relation to the exhaust gas stream so that the first dryer stage is heated by means of the entire amount or a partial amount of the flue gases or exhaust gases discharged from the first combustion chamber. The process according to the invention permits a low-emission, but economical drying process (apparatus) for wood chips. The thermal post-combustion of dryer vapors—in the case of direct as well as indirect heating of the dryers—would destroy the pollutants contained therein, but would cause an economically unjustifiable degree of energy consumption.

Although drying in two stages improves the energetic efficiency of drying, it does not entail an essential reduction of pollutant emission. The combination of both measures makes it possible to carry out the drying of the chips at low emisson of pollutants and reasonable energy expenditure, as the waste heat of post-combustion of the dryer vapors can be completely used for drying. The indirectly heated dryer stage further causes a more gentle drying of the wood chips at simultaneous discharge of water steam from this dryer stage unimpeded by flue gases.

The possibility of the use of the waste heat of post-combustion according to the invention is further subject to the presence of an indirectly heatable dryer. The waste heat can be recovered in the form of steam or thermal oil; the utilization is subject to the presence of a recipient for this heat transfer medium, i.e. when using it for drying, to an indirect heating of at least part of the drying process. The solid, liquid and gaseous organic substances contained in the exhaust gases are virtually completely oxidized and the result is an exhaust gas essentially free of contaminants.

Within the scope of the invention, the organic substances contained in the exhaust gases are heated to at least 700° C., preferably 700° to 1000° C. The temperature required for the oxidation of the organic substances can be reduced if the organic substances contained in the exhaust gases are destroyed within the scope of the invention in the presence of oxidation catalysts such as platinum, chromium oxide or copper oxide on ceramic supports at elevated temperature, as this temperature may then be reduced to at least 300° C., in particular to 300° to 550° C.

If the temperature of the exhaust gas discharged from the first combustion chamber, in particular if catalysts are used is sufficient for the oxidation of the organic substances in the second combustion chamber, the invention provides for the exhaust gas from the first dryer stage to be completely recycled to the first combustion chamber, with the gas discharged from this chamber being divided into two partial streams of which the first is passed to the first dryer stage, while the second is passed to the second combustion chamber in particular provided with a catalyst. Since the gas discharged from the first combustion chamber already has an adequate temperature, no additional fuel is required in the second combustion chamber.

If the temperature of the gas discharged from the first combustion chamber is not high enough for the oxidation of the organic substances, the exhaust gas from the first dryer stage must be brought to the required temperature, thus post-heated, in the second combustion chamber disposed downstream from it with addition of further fuel.

The use of two dryer stages arranged in series in relation to the advance of the wood chips to be dried permits the performance of the process described at particularly high saving in energy due to the use of the indirectly heated second stage dryer. According to a preferred variant of the process according to the invention, the waste heat of the heated exhaust gases can be used for the at least partial heating of the second dryer stage. Within the scope of the invention, it is particularly convenient to let the drying of the wood chips in the first dryer stage reach an extent which makes the waste heat provided by the heating of the exhaust gases at least sufficient for covering the heat requirement of the second dryer stage. It is particularly convenient within the scope of the invention to operate in such a manner that the heat requirement of a chip processing station disposed downstream from the second dryer stage, in particular the heat requirement of presses, is also covered. This can be achieved in a simple manner by providing a further stage in the purified exhaust steam of the dryers which recovers the heat contained in this exhaust steam. By this embodiment of wood chip drying, the drying operation can be carried out at a high degree of thermal efficiency and at the same time virtually without emission because the humidity of the wood chips discharged from the first dryer stage can be selected by appropriate control of the heating of this drying stage. In this way, it is possible to adjust the drying to the changing inlet humidity of the fresh wood chips and to the changing heat requirement of the board presses while at the same time keeping fuel consumption to a minimum, i.e. the thermal efficiency of the drying operation at an optimum.

An apparatus according to the invention of the type initially mentioned for carrying out the process according to the invention is characterized in that the second dryer is indirectly heated, that a first combustion chamber is dispossed downstream from the two dryers and that optionally, a second combustion chamber for heating the exhaust gases of the two dryers is disposed downstream and that the first dryer is connected via a line to the first combustion chamber for its heating with the entire amount or a partial amount of the flue gases and/or exhaust gases of said combustion chamber. This makes is possible to carry out the process according to the invention at low expenditure for apparatus, as the use of differently heated dryers, namely an indirectly heated dryer for the second drying stage, establishes favorable temperature conditions in view, of a convenient thermal efficiency of drying, as the thermal medium in the indirectly heated dryer is substantially less hot than the flue gases used for heating a direct dryer.

A particularly favorable embodiment of the apparatus according to the invention consists of the provision that a line for the exhaust gases leads from the second dryer into a combustion chamber for heating the first dryer from which a further line leads to the first combustion chamber and/or a line into the second combustion chamber for heating the exhaust gases. The exhaust gases from the second combustion chamber are thus sequentially passed to two combustion chambers, which the complete combustion of the pollutants contained therein. If necessary, a line leading back to the combustion chamber for heating the first dryer may branch off from the line leading to the combustion chamber for heating the exhaust gases. The exhaust gases flowing in the former line are also subjected to a two-fold combustion. If the temperature of the gas discharged from the fist combustion chamber is high enough for the oxidation of the organic substances in the second combustion chamber, the arrangement within the scope of the invention is such that a line passing into the second combustion chamber provided with a catalyst branches off from the line carrying the exhaust gases for heating the first dryer in front of the port of an inlet line for the moist chips.

As already mentioned, it is of particular advantage to exploit the waste heat radiating from the combustion chamber for heating the exhaust gases. Within the scope of the invention, a waste heat boiler provided with a waste heat line leading to the second dryer and optionally also to a chip combustion station can be connected to the combustion chamber for recovering the heat of the exhaust gases. From this boiler, a line for the cooled exhaust gases may lead to a condenser to whose gas discharge line a hot air line heated by the waste heat boiler is optionally connected.

The previously mentioned "exhaust gases" of the dryer stages are understood to include the portions in the vapor state.

BRIEF DESCRIPTION OF THE DRAWINGS

FIG. 2 is a schematic view of another preferred embodiment for carrying out the process of this invention; and FIG. 3 is a schematic view of still another preferred embodiment for carrying out the process of this invention.

DESCRIPTION OF THE PREFERRED EMBODIMENT

Figure 1:
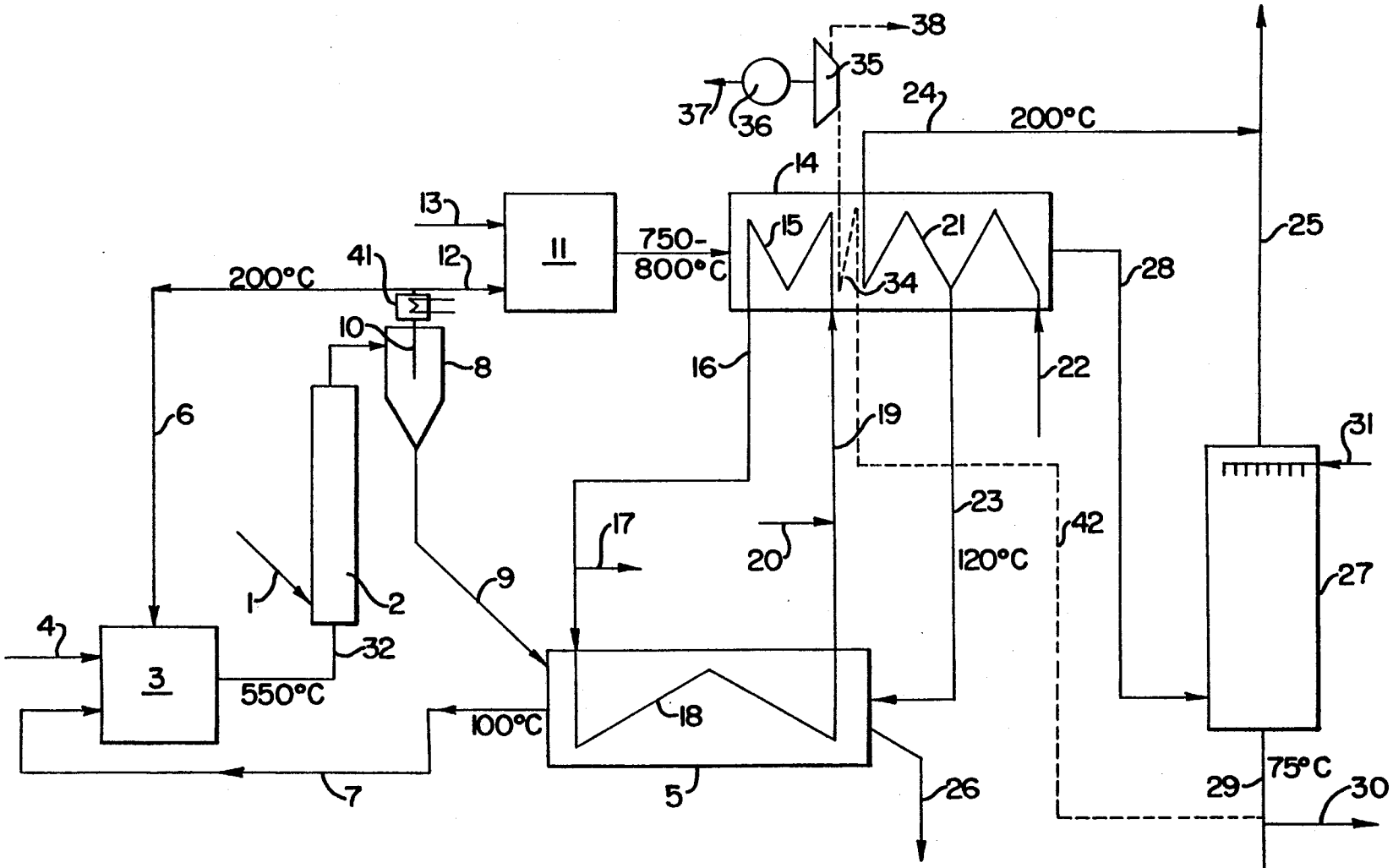
FIG. 1 is a schematic view of a preferred embodiment for carrying out a preferred process of this invention.

The plant shown in FIG. 1 is intended to dry about 60 t of wood chips per hour at an initial humidity of 100 percent of water to a final humidity of 2 percent. To this end, the moist wood chips are passed via a feed line 1 in the amount of 60 t/h to the inlet gate of a first dryer 1 in the form of a directly heated current dryer heated by a combustion chamber 3 via a line 32. The combustion chamber 3 is charged via line 4 with about 4 t/h of wood dust accumulating as waste in producing the wood chips but also on grinding the finished particle boards. This wood dust is burned together with the exhaust gases of the aforementioned first dryer 2 and a second dryer 5, the exhaust gases being fed via lines 6 and 7 at temperatures of about 200° C. and 100° C. The flue gas formed in the combustion chamber 3 with a temperature of about 550° C. flows into the first dryer 2 and there dries the moist wood chips in a conventional manner to a humidity of about 30 percent of water. The exhaust air from the dryer 2 is separated in a conventional material separator 8 from the entrained wood chips which are passed to the second, indirectly heated dryer 5 via a line 9. Connected to the material separator 8 is an exhaust gas line 10 to which the line 5, on the one hand, and the line 12 leading to a further combustion chamber 11, on the other hand, are connected. The exhaust gases fed into the combustion chamber 11 via line 12 are heated by means of about 1,400 $NM^3/h$ of natural gas fed to the combustion chamber 11 via line 13 to a temperature of about 750° to 8000° C. Connected to the combustion chamber 11 is a waste heat boiler 14 in which a thermal oil is heated in a pipe system 15 to a temperature of 2000° C., at which temperature it is discharged from the waste heat boiler 14 via a line 16. This thermal oil is used via a line 17 connected to line 16 for heating the presses used for pressing the particle boards, on the one hand, while on the other handline 16 leads to the indirect heating 18 of the second dryer 5 and from there back again to the pipe system 15 of the waste heat boiler 14 via line 19 to which a line 20 coming from the presses is connected. In the waste heat boiler 14, there is a further pipe system 21 in which air introduced via line 22 is preheated, which air is fed to the second dryer 5 as flushing air at a temperature of about 120° C. via line 23, on the one hand, and to an exhaust gas line 25 leading to the chimney via a line 24 at a temperature of about 200° C., on the other hand.

The second dryer 5 is embodied as an indirectly heated tube dryer in which the chips are brought to the desired final humidity of about 2 percent of water. For removing the evaporated water which amounts to about 8.4 t/h, heated air supplied by line 23 in an amount of about 34,000 $Nm^3/h$ is used, the entire amount of exhaust air flowing into combustion chamber 3 via line 7. The dried chips are discharged from the dryer 5 via discharge line 26 in an amount of about 30.6 t/h.

The exhaust gas of the waste heat boiler 14 constituting a heat exchanger contains the entire water content of the chips and the water from the fuel supplied via lines 4 and 13 in the form of steam. A major portion of the heat content of this exhaust gas can be recovered in a condenser 27 as hot water of about 75° C., the condenser 27 being connected via a line 28 to the outlet of the waste heat boiler 14. The aforementioned hot water leaves the condenser 27 via a line 29 to which a branch line 30 leading to an outfall ditch may be connected.

Since the exhaust gases fed through line 28 are considerably cooled by the aforementioned heat recovery in the consenser 27, the cooled gas discharged from the condenser 27 via exhaust gas line 25 must be slightly reheated before its exit into the atmosphere in order to generate an appropriate ascending force in the chimney. This is conveniently achieved by adding a minor amount (maximum 10,000 $Nm^3/h$ of preheated air via line 24.

The gases exiting from the chimney have a dew point of about 20° C. and under most climatic conditions do not condensate on mixing with the environmental air, i.e. they are not visible. Moreover, they contain virtually no pollutants—aside from small amounts of wood ash—and generate virtually no unpleasant odors.

The volume of exhaust gases evacuated through the chimney amounts to about 60,000 $Nm^3/h$, the amount of cooling water fed to the condenser 27 via a line 31 at a temperature of about 10° C. amounts to about 300 $m^3/h$. The amount of heat supplied to the presses via line 17 amounts to about 12.6 GJ/h.

The directly heated dryer 2 and the indirectly heated dryer 5 may be of known construction and need not be described in detail. As known, a directly heated dryer has a hot gas pipeline heated by the combustion chamber, the hot gas pipeline connects the combustion chamber to the dryer proper and also receives the moist chips via an inlet gate. The transport of the incoming chips in the predrying line is effected by the flue gases from combustion. The chips are then passed to a rotating drying drum consisting of telescoped and mutually firmly connected pipes formed with lifting scoops. From this drum, the chips are passed to the material separator 8 via a separator for separation from the heavy matter.

It is known that in an indirectly heated dryer, the heater 18 is provided in the form of a register formed of rotating banks of tubes, with lifting and conveying scoops rolling or conveying the material to be dried through the dryer and frequently passing it over the register. Blowing in preheated fresh air is conveniently effected into a central main pipe or laterally into a trough in which the register circulates.

Instead of to a single dryer 5, predried wood chips can be fed to a plurality of indirectly heated dryers 5 in parallel via line 9. An arrangement like this may be convenient for reasons of efficiency, the mutually parallel dryers 5 being uniformly supplied with thermal oil by the waste heat boiler 14, In front or behind the combustion chamber 11, a (not represented) electrofilter for fly ash responding to wet gas may be embedded in the exhaust gas stream. An embodiment like this is convenient if the proportion of dust in the exhaust gases is high.

The exemplary embodiment according to FIG. 2 is similar to that of FIG. 1, but heated air supplied by the waste heat boiler 14 or its pipe system 21 via a line 34 branching off to the combustion chambers 3, 11 is provided as an additional source of energy for the combustion chambers 3, 11. This embodiment, just like the one according to FIG. 1, is intended for the case in which the temperature of the gas discharged from the first combustion chamber 3 does not suffice for the oxidation of the organic substances in the second combustion chamber 2, so that there, the exhaust gas from the first dryer 2 must be brought to the required temperature by adding further fuel (natural gas via line 13).

FIG. 3 shows a plant intended for the case that the temperature of the gas discharged from the first combustion chamber 3 suffices for the oxidation of the organic substances in the second combustion chamber 11. This may be enhanced by the fact that the second combustion chamber 11 is equipped with oxidation catalysts by means of which the temperature required for the oxidation of the organic substances can be lowered to about 300° to 550° C. For this case, a line 33 branches off in front of the port of the inlet line 1 from the line 32 via which the exhaust gases of the combustion chamber 3 are supplied to the first dryer 2 for heating it, which line 33 passes the aforementioned exhaust gases from the combustion chamber 3 directly to the second combustion chamber 11, for instance at a temperature of 500° C. In this case, the exhaust gas from the first dryer stage 2 is completely recycled from the material separator via line 6 to the combustion chamber 3 of the first stage and—as already mentioned—the gas discharged from this combustion chamber 3 is divided into two partial streams passed via the two lines 32 and 33 to the dryer 2 or the combustion chamber 11. As the gas discharged from the first combustion chamber 3 already has a sufficient temperature for heating the second combustion chamber 11 for the purpose of oxidizing the organic components, no additional fuel is required in the second combustion chamber 11. Line 13 according to the embodiments according to FIGS. 1 and 2 can thus be omitted in the construction according to FIG. 3, just like the energy supply via line 34 for combustion chamber 11.

It goes without saying that a (not represented) thermal oil boiler can be included in the circulation of the thermal oil (lines 16, 19).

In FIG. 1, broken lines show further developments of the apparatus according to the invention. A condenser water line and/or a feed-water line 42 are passed via a heat exchanger 34 in the waste heat boiler 14 in order to generate superheated high-pressure steam. This steam is released in a counter pressure turbine 35 and generates current in a generator 36. The released steam (line 38) can then be used for drying or for the heat requirement of presses. The generated current (line 37) can cover the energy requirement of a chip processing station disposed downstream from the second dryer stage or operate presses heated or heating with high frequency.

It may further be convenient to provide a heat exchanger 41 in the exhaust gas line of the material separator 8 in order to recover heat and/or reduce the volume or air generated.

I claim:

1. A process for the low-emission drying of wood chips comprising:

predrying said wood chips in a first dryer stage to a humidity content of about 20 to about 50%, wherein said first dryer is heated with flue-gas from a combustion chamber;

finish-drying said predried wood chips to a humidity content of about 1 to about 6% in a second dryer stage disposed downstream from said first dryer stage wherein said second dryer stage is indirectly heated;

recycling at least a portion of the exhaust gases discharged from said first dryer stage and said second dryer stage to said combustion chamber;

destroying the organic substances contained in the exhaust gases from both dryer stages by means of oxidation at elevated temperature prior to the evacuation of the exhaust gases into the atmosphere by heating the exhaust gases of said dryers in said combustion chamber; and discharging said exhaust gases into the atmosphere.

2. The process according to claim 1, wherein the exhaust gas of said first dryer stage is completely recycled to combustion chamber and the gas discharged from said combustion chamber is divided into two streams, of which the first one is passed to said first dryer stage, while the second one is passed to a second combustion chamber.

3. The process according to claim 2 wherein said organic substances contained in said exhaust gases are destroyed in the presence of an oxidation catalyst selected from the group consisting of platinum chromium oxide and copper oxide, on ceramic supports at a temperature of at least 300° C.

4. The process according to claim 3 wherein said temperature is between 300° C. and about 550° C.

5. The process according to claim 1 wherein said organic substances contained in said exhaust gases are destroyed in the presence of an oxidation catalyst selected from the group consisting of platinum chromium oxide and copper oxide, on cēramic supports at a temperature of at least 300° C.

6. The process according to claim 5 wherein said temperature is between 300° C. and about 550° C.

7. The process according to claim 1, wherein said organic substances contained in said exhaust gases are destroyed by heating to a temperature of at least 700° C.

8. The process according to claim 7, wherein the organic substances contained in the exhaust gases are heated to a temperature between about 700° C. and about 1000° C.

9. The process according to claim 1, wherein at least a portion of the exhaust gas from said first dryer is post-heated in a second combustion chamber disposed downstream from said first combustion chamber with addition of further fuel.

10. The process according to claim 9 wherein said organic substances contained in said exhaust gases are destroyed in the presence of an oxidation catalyst selected from the group consisting of a platinum chromium oxide and copper oxide, on ceramic supports at a temperature of at least 300° C.

11. The process according to claim 10 wherein said temperature is between 300° C. and about 550° C.

12. The process according to claim 1, wherein the waste heat of the heated exhaust gases is used for at least partial heating of the second dryer stage.

13. The process according to claim 12, wherein the wood chips are dried in the first dryer stage to such an extent that the waste heat available from heating the exhaust gases suffices at least for covering the heat requirement of the second dryer stage.

14. The process according to claim 1, wherein the wood chips are dried in said first dryer stage to such an extent that the waste heat available from heating the exhaust gases suffices for covering the heat requirement of said second dryer stage and the heat requirement of a chip processing station.

15. The process according to claim 1, wherein the exhaust gases from the second dryer stage are mixed with additional fuel and burned in the first combustion chamber whose waste heat heats the first dryer stage whose exhaust gases are mixed with additional fuel and burned in the second combustion chamber.

16. The process according to claim 1, wherein at least one biogenous fuel is used for heating said first dryer stage and fossile fuel is used for heating the second dryer stage.

17. The process according to claim 1, wherein said biogenous fuel is wood dust, and said fossile fuel is natural gas.

18. An apparatus for low emission drying of wood chips comprising:

a first dryer for pre-heating moist wood chips, a second dryer disposed downstream from said first dryer, wherein said second dryer is indirectly heated, a first combustion chamber for heating the exhaust gases of said two dryers and that the first dryer is connected via a line to the first combustion chamber for heating said first dryer with at least a portion of the gases from said first combustion chamber, and a second combustion chamber disposed downstream from said dryers and said first combustion chamber for further heating at least a portion of the exhaust gases from said dryer.

19. The apparatus according to claim 18, wherein a line (7) for the exhaust gases from the second dryer (5) leads to a combustion chamber (3) for heating the first dryer (2) from which a further line (12) leads to the first combustion chamber (3) or a line (12) leads to the second combustion chamber (11) for heating the exhaust gases.

20. The apparatus according to claim 18, wherein a line (6) leading back to the combustion chamber (3) for heating the first dryer (2) branches off from the line (12) leading to the combustion chamber (11) for heating the exhaust gases.

21. The apparatus according to claim 18, wherein a line (33) leading into the second combustion chamber (11) equipped with a catalyst branches off from the line (32) conveying the exhaust gases for heating the first dryer (2) in front of the port of an inlet line (1) for the moist chips.

22. The apparatus according to claim 18, wherein a waste heat boiler (14) having a line (16) for conveying waste heat to the second dryer (5) is connected the combustion chamber (11) for the recovery of heat from the exhaust gases.

23. The apparatus according to claim 18, wherein a line (28) for the cooled exhaust gases leads from the waste heat boiler (14) to a condenser (27) to whose line (25) for the discharge of gases is connected to a line (24) heated by the waste heat boiler (14) and serving for conveying warm air is.

24. The apparatus according to claim 18, wherein the waste heat boiler (14) comprises a heat exchanger (34) for generating superheated high pressure steam from condensate and/or feed water, said steam being conveyed via a counter pressure turbine (35) with generator (36).

25. The apparatus according to claim 24, wherein a heat exchanger (41) is arranged in the exhaust gas line (7) of the directly heated dryer (2).

26. The apparatus according to claim 1, wherein an oxidation catalyst from the group consisting of platinum, chromium oxide or copper oxide is provided on ceramic supports at least in combustion chamber (3) for reducing the temperature required for the destruction of the organic substances contained in the exhaust gases.

* * * * *

UNITED STATES PATENT AND TRADEMARK OFFICE

CERTIFICATE OF CORRECTION

PATENT NO. : 5,263,266

DATED : November 23, 1993

INVENTOR(S) : Schmidt

It is certified that error appears in the above-identified patent and that said Letters Patent is hereby corrected as shown below:

On the title page, item [54] and column 1, line 2, before "Low-Emission", please insert --Process Of--.

Column 1, line 16, "ar" should be --are--.

Column 1, line 31, after "pressing" insert --)--.

Column 2, line 9, "pollute" should be --polluting--.

Column 2, line 24, "indreatly" should be --indirectly--.

Column 2, line 27, "directly" should be --indirectly--.

Column 2, line 43, after "second" delete --,--.

Column 4, line 19, "dispossed" should be --disposed--.

Column 4, line 26, "is" should be --it--.

Column 4, line 27, after "for" insert --the--.

Column 4, line 30, after "view" delete --,--.

Column 4, line 41, "combustion chamber" should be --dryer--.

Column 4, line 50, "fist" should be --first--.

UNITED STATES PATENT AND TRADEMARK OFFICE

CERTIFICATE OF CORRECTION

PATENT NO. : 5,263,266

DATED : November 23, 1993

INVENTOR(S) : Schmidt

It is certified that error appears in the above-identified patent and that said Letters Patent is hereby corrected as shown below:

Column 5, line 43, "$NM^3/h$" should be --$Nm^3/h$--.

Column 5, line 45, "8000°C." should be --800°C.--.

Column 5, line 48, "2000°C." should be --200°C.--.

Column 5, line 52, "handline" should be --hand, line--.

Column 6, line 17, "consenser" should be --condenser--.

Column 6, line 34, "$m^3/h$" should be --$Nm^3/h$--.

Column 6, line 63, after "14" delete --,-- and insert --.-- therefor.

UNITED STATES PATENT AND TRADEMARK OFFICE

CERTIFICATE OF CORRECTION

PATENT NO. : 5,263,266

DATED : November 23, 1993

INVENTOR(S) : Schmidt

It is certified that error appears in the above-identified patent and that said Letters Patent is hereby corrected as shown below:

Column 10, line 16, after "connected" insert --to--.

Column 10, line 24, "is" should be deleted.

Signed and Sealed this

Fourth Day of October, 1994

Bruce Lehman

*Attest:*

BRUCE LEHMAN

*Attesting Officer*

*Commissioner of Patents and Trademarks*